US011156024B1

(12) United States Patent
Lawrence

(10) Patent No.: US 11,156,024 B1
(45) Date of Patent: Oct. 26, 2021

(54) WINDOW OPENING CONTROL DEVICE

(71) Applicant: Barry G. Lawrence, Trinity, NC (US)

(72) Inventor: Barry G. Lawrence, Trinity, NC (US)

( * ) Notice: Subject to any disclaimer, the term of this patent is extended or adjusted under 35 U.S.C. 154(b) by 0 days.

(21) Appl. No.: 16/681,313

(22) Filed: Nov. 12, 2019

(51) Int. Cl.
*E05C 17/02* (2006.01)
*E05F 5/00* (2017.01)

(52) U.S. Cl.
CPC ..... *E05C 17/02* (2013.01); *E05F 5/003* (2013.01)

(58) Field of Classification Search
CPC .... E05C 17/02; E05C 17/60; E05C 2007/007; E05F 5/003; Y10T 292/65
See application file for complete search history.

(56) References Cited

U.S. PATENT DOCUMENTS 1,279,353 A * 9/1918 Kelly et al. ..... E05B 65/0852 292/219
5,248,174 A * 9/1993 Matz et al.
5,452,925 A * 9/1995 Huang ..... E05B 65/0817 292/57
5,536,052 A * 7/1996 Maier
5,575,116 A 11/1996 Carlson et al.
6,572,158 B2 * 6/2003 Szapucki et al.
7,431,356 B2 * 10/2008 Liang ..... E05B 65/0852 292/219
7,494,164 B1 * 2/2009 Garries et al.
7,530,611 B2 * 5/2009 Liang ..... E05B 65/0829 292/338
7,559,588 B2 * 7/2009 Liang
7,588,271 B1 * 9/2009 Lawrence ..... E05B 65/0852 292/240
7,600,796 B2 * 10/2009 Liang ..... E05C 17/50 292/207
7,637,544 B2 * 12/2009 Liang ..... E05C 17/50 292/338
8,235,430 B2 * 8/2012 Liang ..... E05B 15/04 292/338
8,360,484 B2 * 1/2013 Liang ..... E05C 17/60 292/220
8,403,382 B2 * 3/2013 Della-Santa ..... E05C 17/56 292/251.5
8,707,625 B2 * 4/2014 Raz ..... E05C 19/002 49/400

(Continued)

*Primary Examiner* — Victor D Batson
*Assistant Examiner* — Matthew J Sullivan
(74) *Attorney, Agent, or Firm* — Tuggle Duggins P.A.; Blake P. Hurt

(57) ABSTRACT

A window opening control devices in the nature of a modified vent stop includes a housing having a peripheral flange defining an opening and a body depending from the peripheral flange and further includes a butterfly shaped stop block mounted within the body of the housing for rocking motion about a generally centrally located pivot point between an open position, wherein a first wing of the stop block extends beyond the housing flange, and a closed position wherein the first wing is retracted into the housing. Movement of the stop block between the open and closed positions is effected by pressing on either the first wing of the butterfly shaped stop block or a second wing, and is preferably accomplished without the use of springs or other biasing assistance. The stop block is preferably provided with a pair of ridge projections that cooperate with spring legs located on the interior of the housing to form a detent to maintain the stop block in the closed position.

17 Claims, 5 Drawing Sheets

(56) References Cited

U.S. PATENT DOCUMENTS

| | | | | |
|---|---|---|---|---|
| 8,776,440 | B2 * | 7/2014 | Sopkowiak | E05C 17/60 49/449 |
| 8,776,442 | B1 * | 7/2014 | Lawrence | |
| 8,789,862 | B2 * | 7/2014 | Liang | E05B 63/0056 292/300 |
| 8,806,809 | B1 * | 8/2014 | Lawrence | E05D 13/06 49/449 |
| 8,833,809 | B2 | 9/2014 | Liang et al. | |
| 8,881,461 | B2 * | 11/2014 | Derham | E05C 1/10 49/449 |
| 9,404,288 | B2 * | 8/2016 | Curtis | E05C 17/50 |
| 9,435,149 | B1 * | 9/2016 | Glickman | E05C 17/60 |
| 9,840,860 | B2 * | 12/2017 | Liang | E05B 65/0847 |
| 10,107,021 | B1 * | 10/2018 | Liang | E05C 3/04 |
| 2005/0146143 | A1 * | 7/2005 | Lutfallah | E05C 17/48 292/153 |
| 2007/0222234 | A1 * | 9/2007 | Liang | E05C 17/50 292/338 |
| 2009/0206616 | A1 * | 8/2009 | Liang | E05C 17/60 292/338 |
| 2010/0147042 | A1 * | 6/2010 | Chen | E05C 17/60 70/99 |
| 2010/0300000 | A1 * | 12/2010 | Liang | E05B 65/0829 49/449 |
| 2018/0179794 | A1 * | 6/2018 | Wu | E05C 3/14 |
| 2018/0209186 | A1 * | 7/2018 | Van Essen | E05C 17/50 |

* cited by examiner

WINDOW OPENING CONTROL DEVICE

FIELD OF THE INVENTION

The invention herein pertains to window hardware in general and in particular to a window opening control device similar to a window vent stop but used to control the manner in which window sashes may be moved relative to one another, particularly vertically.

DESCRIPTION OF THE PRIOR ART AND OBJECTIVES OF THE INVENTION

While windows come in a variety of shapes, sizes and types, two of the most common types of windows in use are known as hung windows and sliding windows. Both of these types of windows have at least one sash that slides relative to another sash as the window is open or closed. With a double hung window, two sashes can move independent of one another in a vertical, up/down direction whereas with a double sliding window the sashes slide in a horizontal, side-to-side direction. The single hung and single slider window variations have only one moving sash while the other is fixed.

There is often a need to open the window to allow fresh air to enter the building or for stale air to exit. A partially or fully open window, however, presents an easy access point to enter the premises and thus presents a security risk. In addition, a fully open window presents a safety risk for a child or small adult who might fall out of the window if the opening is large enough. Moreover, it is often desired to open a window, particularly the single hung and double hung window, at least partially even when raining outside and allow in fresh air, or vent stale air, while minimizing the amount of water entering the premises. Vent stops have been developed and used in the prior art to achieve these objectives.

Generally speaking, a vent stop is a device that is installed in the outermost window sash on the surface against which the innermost sash slides. The vent stop is recessed into the sash so as to be flush with the surface of the sash when not in use. When needed, the stop is manually activated to raise a portion of the stop above the surface of the sash, thus limiting the ability of the two sashes to slide against one another.

Several prior art window stop devices have been proposed, including U.S. Pat. Nos. 5,575,116; 8,235,430; 8,360,484; and 8,806,809. The disclosures of these references are incorporated herein in their entirety by reference. While these prior art devices function well enough, they are complicated to manufacture and involve intricate detent mechanisms to maintain the stop blocks in the closed position which makes them undesirable and expensive.

Accordingly, there is a need for a window opening control device in the nature of a specialized window vent stop that has minimal moving parts and is simple to manufacture, assemble and operate.

SUMMARY OF THE INVENTION

In accordance with a preferred embodiment, a window opening control device comprises a housing having a peripheral flange defining an opening and a body depending from the peripheral flange. The housing is equipped with a clip at one end and a spring clamp at the other to provide for a snap lock type installation like that of a vent stop into a corresponding opening in the sash. A stop block is mounted within the body of the housing for rocking motion about a generally centrally located pivot point and is positioned within the opening in the flange. The stop block has a first wing and a second wing oriented at an obtuse angle relative to one another, forming a butterfly shaped member. The first wing of the stop block is oriented to engage a window sash when the sash is in a down position. By depressing the first wing into the housing, the second wing will rise toward the flange as the stop block pivots. Depressing the second wing into the housing causes the first wing to rise. The push to open, push to close operation causes a rocking movement of the stop block. Ridges on the first wing coordinate with a respective pair of spring legs on the interior of the housing to retain the first wing in a closed position wherein the first wing is retracted within the housing. In this position, the second wing may be depressed, against the force of the ridges and spring legs to raise the first wing into the up position.

DETAILED DESCRIPTION OF THE PREFERRED EMBODIMENT AND OPERATION OF THE INVENTION

Figure 1:
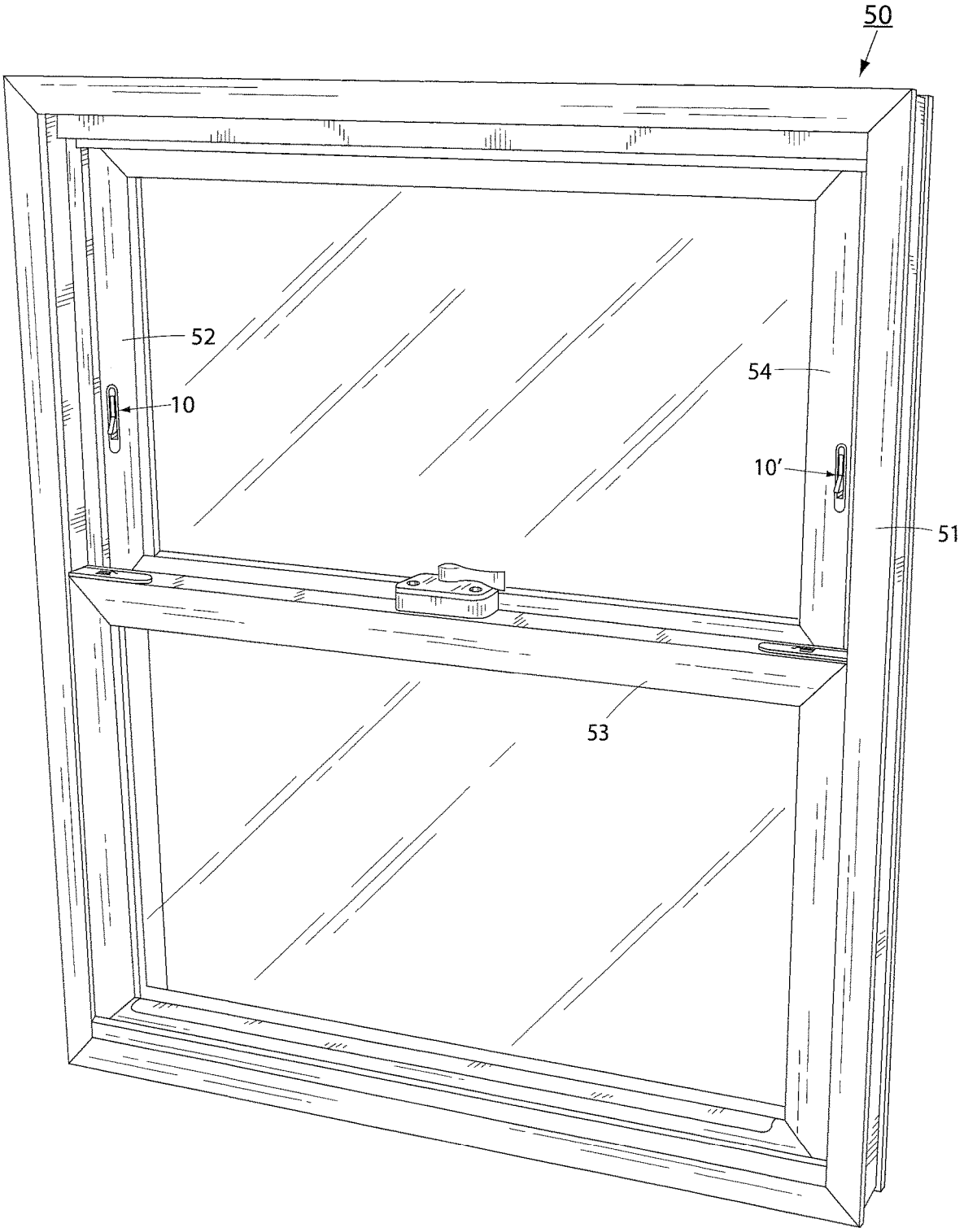
FIG. 1 is a perspective view of a typical single or double hung window unit showing the window opening control device installed therein.

For a better understanding of the invention and its operation, turning now to the drawings, FIG. 1 illustrates a typical single or double hung window 50 having a frame 51, an upper sash 52 and a lower sash 53. In the view shown in FIG. 1, the lower sash 53 may be considered the innermost sash because it is closest to the interior of the building and sash 52 is correspondingly considered the outermost sash. A pair of window opening control devices 10, 10' are shown recessed into the inner face 54 of upper sash 52. Inner face 54 is the face against which lower sash 53 slides as the lower sash 53 is raised or lowered. In this preferred embodiment, these window opening control devices (that somewhat resemble modified vent stops) 10, 10' are oriented in inner face 54 with a longitudinal axis generally parallel to that of a longitudinal axis defined by window 50, configuring the stop block 14 to extend inwardly from upper sash 52 to engage with lower sash 53 as will be described in further detail below. In an alternate embodiment, window opening control devices 10, 10' are oriented with a longitudinal axis generally parallel to that of a longitudinal axis defined by window 50, but positioned such that stop block 14 extends transversely in a direction from one side of frame 51 to the other, for example (but by no means intended as a limitation) positioned in the window jamb or the laterally facing surface of window frame 51.

Figure 2:
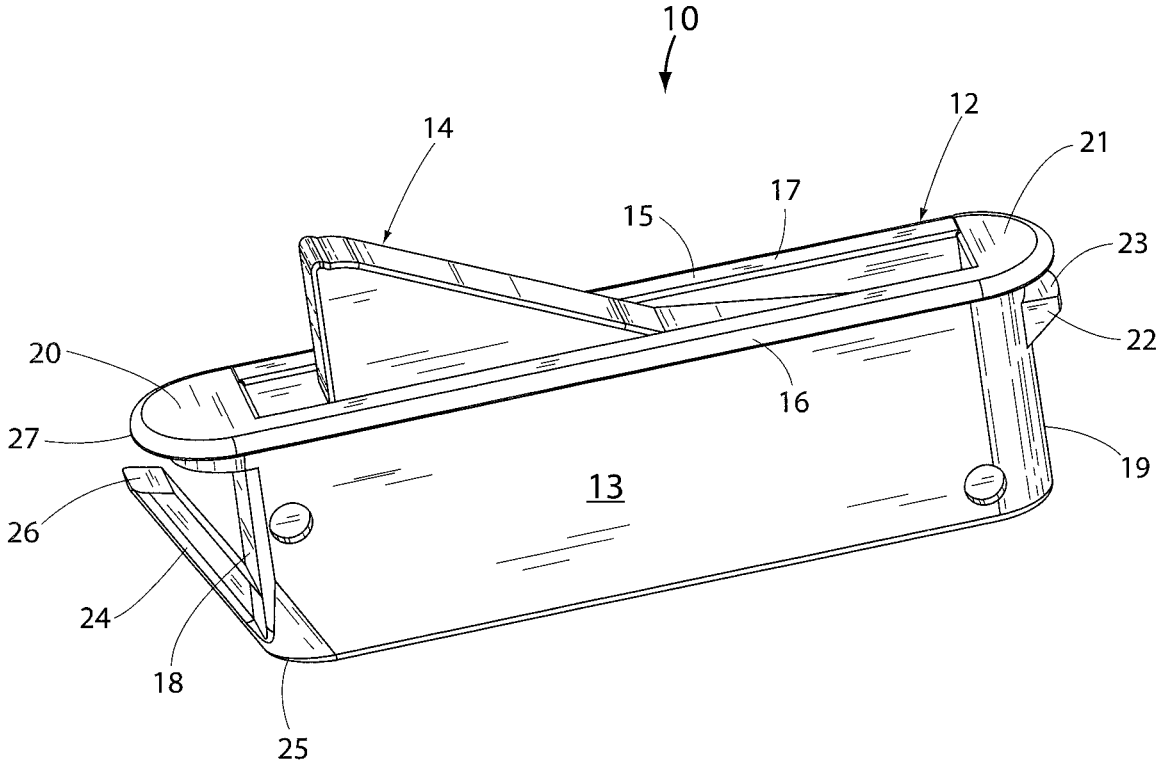
FIG. 2 is an enlarged perspective view of a preferred embodiment of the window opening control device of the invention, as seen from the right side of the device.
Figure 3:
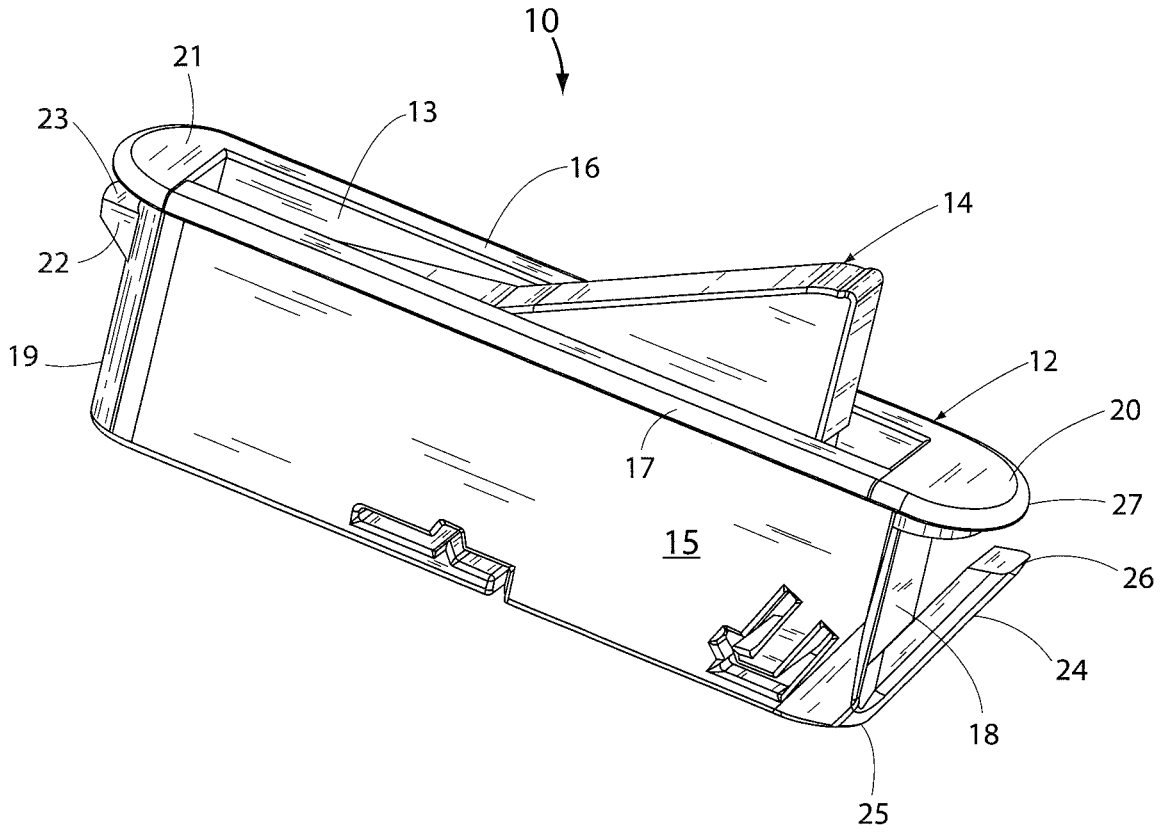
FIG. 3 is an enlarged perspective view of a preferred embodiment of the window opening control device of the invention, as seen from the left side of the device.

With reference to FIGS. 2 and 3, the window opening control device 10 has a housing 12 and a stop block 14. Housing 12 preferable comprises a two-piece unit, having a right half 13 and a left half 15 and two longitudinal ends, 18, 19 with the longitudinal end 18 being referred to herein as the "front" end and longitudinal end 19 being referred to as the "rear" end for convenience. Each of the preferred right half 13 and left half 15 of the housing 12 defines an outwardly turned upper surface forming longitudinal flanges 16, 17, respectively. The front end 18 and rear end 19 of the housing 12 each may have semi-circular flanges 20, 21 respectively. Flanges 16, 17, 20 and 21 together form a face peripheral flange of the housing and define an opening 11 therein. The stop block 14 is positioned within the opening 11. Temis such as front, rear, right, left, top, and bottom are included for context and ease of reference, but are not intended to be construed as a limitation on the instant invention.

Rear end 19 of housing 12 preferably includes a ledge 22 having a flat upper surface 23 that is spaced from the bottom of semi-circular flange 21. The distance between the ledge surface 23 and the flange 21 may be selected based on the typical thickness of the material used to build the sash, most often vinyl or fiberglass in current windows. The front end 18 of the housing 12 preferably includes a spring leg 24 connected at a proximal end to the bottom 25 of the housing 12 and extends outwardly therefrom at an angle oriented toward the semi-circular flange 20. The distal end 26 of the spring leg 24 extends beyond the leading edge 27 of semi-circular flange 20.

The window opening control device 10 can easily be installed into a suitably sized and shaped opening in the widow sash. For example, the rear end 19 may be inserted first by positioning the edge of the opening in the sash within the space between the ledge surface 23 and the underside of flange 21 to frictionally engage the sash material between the ledge 22 and the flange 21. The front end 18 of the housing 12 may be pivoted toward the sash, forcing the spring leg 24 toward the front end 18 of housing 12. Once the spring leg 24 is no longer in contact with the edge of the opening in the sash, the spring leg 24 reverts back to its normal extended position shown in FIGS. 2 and 3 and retains the housing 12 in the opening, with the semicircular flanges 20, 21 positioned in intimate contact with the surface of the sash.

The front and rear ends 18, 19 of the housing 12 are preferably integrally foil led with the right half 13 of housing 12 in the Figures, although this need not always be the case. It is preferred to make the housing members 13, 15 asymmetrical and not merely mirror images of one another for ease of manufacture and assembly, but it is noted to be within the skill of the ordinary artisan to make suitable modifications if desired.

Figure 4:
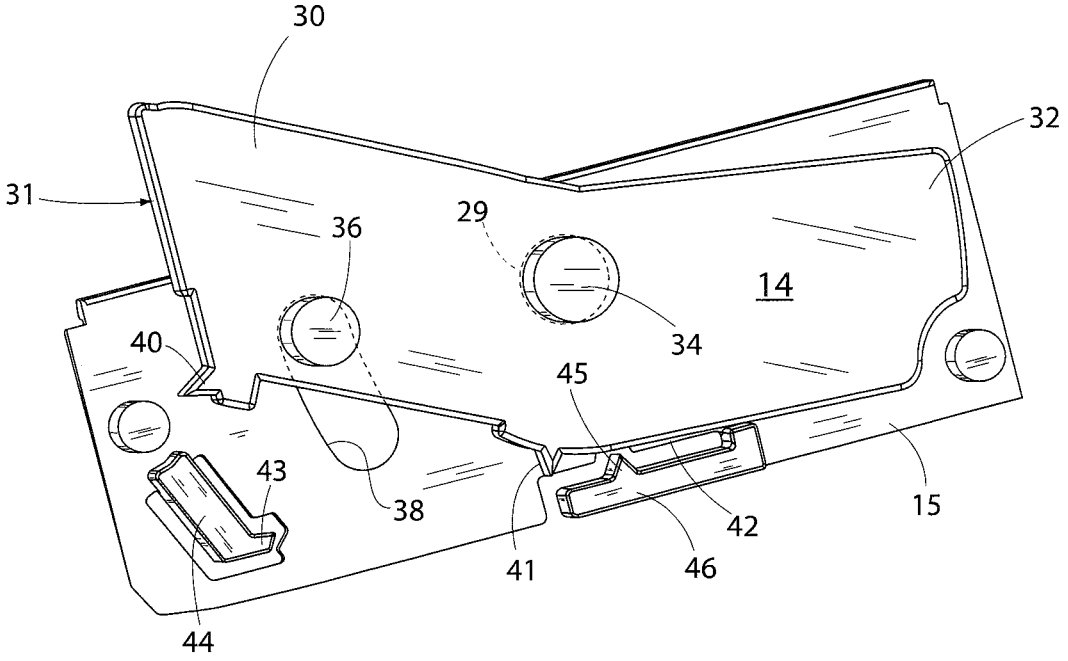
FIG. 4 is a perspective view of a preferred embodiment of the window opening control device of the invention, with one half of the housing removed and particularly illustrating the dual face stop member in the open position.
Figure 5:
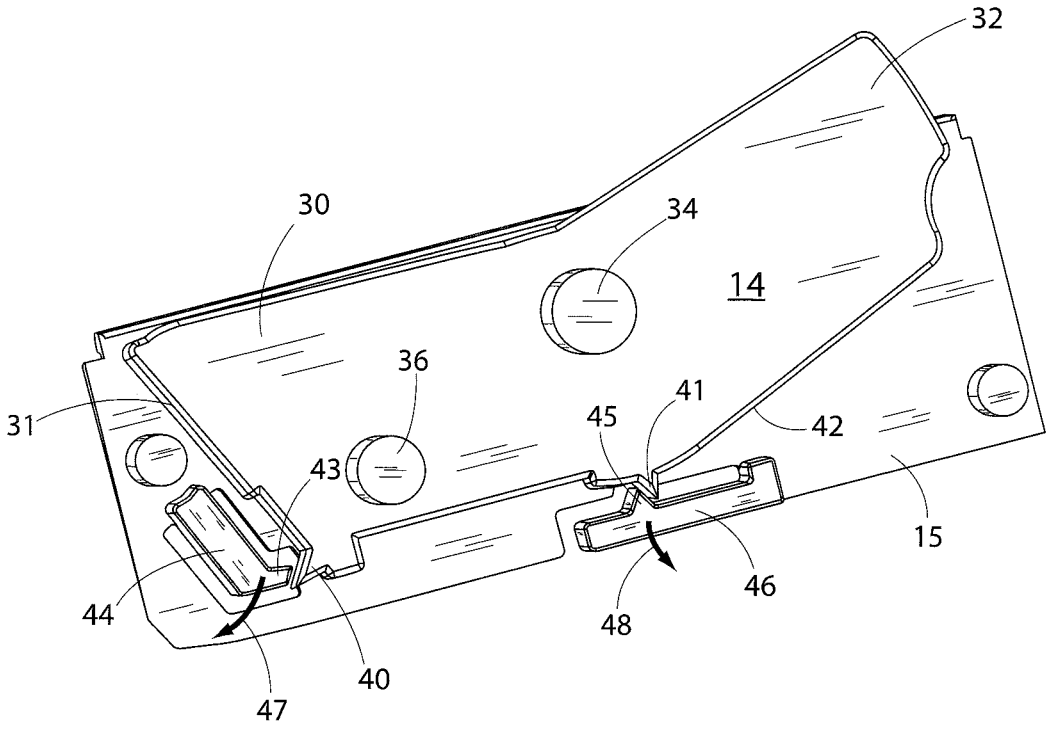
FIG. 5 is a perspective view of a preferred embodiment of the window opening control device of the invention, with one half of the housing removed and particularly illustrating the dual face stop member in the closed position.

With reference now made to FIGS. 4 and 5, an embodiment of stop block 14 is shown in the open position in FIG. 4 and in the closed position in FIG. 5. As shown, the stop block 14 preferably defines a first wing 30 and a second wing 32 oriented at an obtuse angle to one another, thus forming a flattened "V" or butterfly wing-shaped member. When in the open position of FIG. 4, the front edge 31 of wing 30 will be in the location of travel of lower window sash 53, thus limiting the movement of lower sash 53, ideally vertically. When in the closed position of FIG. 5, the lower sash is free to pass by the window opening control device 10 unencumbered.

The stop block 14 has a cylindrical pivotal protrusion 34 located in the general center of the stop block 14. A corresponding protrusion (not shown in the Figures) is located on the opposite side of the stop block 14 and in alignment with cylindrical pivotal protrusion 34. These cylindrical pivotal protrusions 34 frictionally fit within corresponding recesses 29, (only one shown in FIG. 4) located on the interior walls of right side 13 and left side 15 of housing 12, such that stop block 14 pivots by protrusions 34 within recesses 29 as it is moved between the open position shown in FIG. 4 to the closed position shown in FIG. 5.

To further guide the rocking motion of stop block 14, a pair of cylindrical projections 36 is provided on the stop block 14. These cylindrical projections 36 are preferably sized and shaped to fit within corresponding curved channels 38 in the inner surfaces of the right side 13 and left side 14 of the housing 12. Only one projection 36 and one channel 38 are shown in FIGS. 4 and 5, it being understood that a like projection 36 is located on the opposite side of the stop block 14 and that a like curved channel 38 is located on the inner surface of right side 13 of housing 12. One or more embodiments of channel, 38 may define a straight geometry as may be desirable (not shown).

A ridge projection 40 is preferably located on the lower portion of front edge 31 of wing 30. A similar ridge projection 41 may be defined along the bottom surface 42 of the stop block 14 and about in the center, below the pivot point cylindrical protrusion 34. To move the stop block 14 from the open position to the closed position, the first wing 30 is depressed toward the housing 12. Upon such movement, ridge projection 40 may engage a ridge projection 43 on spring leg 44, located on the inner surface of left side 15 of housing 12. Similarly, ridge projection 41 may engage a ridge projection 45 on spring leg 46, also preferably located on the inner surface of left side 15 of housing 12. Upon such engagement, the spring legs 44, 46 will deform and/or deflect away from the ridge projections 40, 41 as shown by arrows 47 and 48 in FIG. 5. Further rotation of the stop block 14 will allow spring legs 44, 46 to revert back to their original positions; forming detents to maintain the stop block 14 in the closed position. To move the stop block 14 from the closed position of FIG. 5 to the open position of FIG. 4, the second wing 32 will be depressed into the housing, forcing the spring legs 44, 46 to deflect in the direction of arrows 47, 48 and allowing the stop block 14 to continue to pivot into the fully open position of FIG. 4.

The illustrations and examples provided herein are for explanatory purposes and are not intended to limit the scope of the appended claims. Changes in the shapes and materials employed herein are anticipated by those skilled in the art as different plastics, sizes and configurations may be used as available without departing from the inventive concept divulged.

I claim:

1. A window opening control device comprising a housing having a peripheral flange defining an opening, a body depending from the peripheral flange, a clip at one end of the housing and a spring clamp at an opposite end of the housing to provide for a snap lock type installation of the window opening control device into an opening in a window sash, and first and second spring leg detents located within the body of the housing; a stop block defined by a butterfly wing shaped member with a first wing and a second wing oriented at an obtuse angle to one another, the stop block further defining first and second ridge projections extending from a bottom surface thereof, the stop block mounted within the body of the housing for pivotal movement between an open position and a closed position about a pivot axis generally centrally located on the stop block, the first spring leg detent configured to cooperate with the first ridge projection and the second spring leg detent configured to cooperate with the second ridge projection to maintain the stop block in the closed position.

2. The window opening control device of claim 1, wherein the housing comprises a two-piece housing, wherein each piece of the housing includes portions of the peripheral flange and the body.

3. The window opening control device of claim 1, wherein the housing comprises a two-piece housing, wherein each piece of the housing includes portions of the peripheral flange and the pieces are asymmetrical relative to one another.

4. The window opening control device of claim 1, wherein the first wing is larger than the second wing.

5. The window opening control device of claim 1, wherein the stop block is in the open position, the first wing is extended outside of the housing.

6. The window opening control device of claim 1, wherein when the stop block is in the open position, the first wing is extended outside of the housing and when in the closed position, the first wing is retracted into the housing.

7. The window opening control device of claim 1, wherein when the stop block is in the open position, the first wing is extended outside of the housing and when in the closed position, the first wing is retracted into the housing; and wherein the stop block is configured to move between the open and closed positions by via urging respective one of the first or second wings.

8. The window opening control device of claim 1, wherein the stop block is configured to move between the open and closed positions by via urging respective one of the first or second wings.

9. The window opening control device of claim 1, wherein the stop block is configured to move between the open and closed positions by via urging respective one of the first or second wings; and wherein the movement of the stop block from the closed position to the open position is without mechanically biasing assistance.

10. The window opening control device of claim 1, wherein the stop block is configured to move between the open and closed positions by via urging respective one of the first or second wings.

11. The window opening control device of claim 1, wherein the stop block defines a butterfly wing-shaped member having cylindrical protrusions in the general center of the stop block and on opposite sides thereof, the cylindrical protrusions fitting within corresponding recesses on interior surfaces of the housing, the cylindrical protrusions and the recesses forming the pivot point for the stop block.

12. The window opening control devices of claim 1, wherein the stop block defines a butterfly wing-shaped member having cylindrical projections on the first wing thereof, the cylindrical projections fitting within different ones of a curved channel formed on interior surfaces of the housing, the cylindrical projections sliding along the curved channels as the stop block pivots between the open and closed positions.

13. The window opening control device of claim 1, wherein the stop block defines a butterfly wing-shaped member having cylindrical protrusions in the general center of the stop block and on opposite sides thereof, the cylindrical protrusions fitting within different ones of a corresponding recess on interior surfaces of the housing, the cylindrical protrusions and the corresponding recesses forming the pivot point for the stop block, and wherein the stop block has cylindrical projections on the first wing thereof, the cylindrical projections on the first wing fitting within corresponding curved channels on interior surfaces of the housing, the cylindrical projections on the first wing sliding along the curved channels as the stop block pivots between the open and closed positions.

14. The window opening control device of claim 1, further comprising a spring leg defined at a proximal end to a bottom of the housing and extending outwardly therefrom at an angle oriented toward the flange.

15. The window opening control device of claim 14, wherein a distal end of the spring leg extends beyond a leading edge of the flange.

16. The window opening control device of claim 1, further comprising a ledge having that is spaced from a bottom of the flange.

17. The window opening control device of claim 16, wherein the ledge defines a flat upper surface.

* * * * *